US007506418B2

(12) United States Patent
Dingel

(10) Patent No.: US 7,506,418 B2
(45) Date of Patent: Mar. 24, 2009

(54) BUCKLE BUMPER

(75) Inventor: Bryan Dingel, Boise, ID (US)

(73) Assignee: Northwest River Supplies, Inc., Moscow, ID (US)

( * ) Notice: Subject to any disclaimer, the term of this patent is extended or adjusted under 35 U.S.C. 154(b) by 0 days.

(21) Appl. No.: 10/985,723

(22) Filed: Nov. 9, 2004

(65) Prior Publication Data

US 2006/0096068 A1 May 11, 2006

(51) Int. Cl.
*A44B 11/25* (2006.01)

(52) U.S. Cl. ..... 24/633; 24/634; 24/629

(58) Field of Classification Search ..... 24/633, 24/629

See application file for complete search history.

(56) References Cited

U.S. PATENT DOCUMENTS

| | | | | | |
|---|---|---|---|---|---|
| 0,355,107 | A | | 12/1886 | Scollay | |
| 0,688,677 | A | | 12/1901 | Paddock | |
| 1,483,853 | A | | 2/1924 | Schwerd | |
| 2,889,165 | A | | 6/1959 | Zientara | |
| 3,046,056 | A | | 7/1962 | Greene et al. | |
| 3,184,880 | A | | 5/1965 | Ratte | |
| 3,276,085 | A | | 10/1966 | Spranger | |
| 3,484,908 | A | * | 12/1969 | Lamb | 24/579.11 |
| 4,368,563 | A | | 1/1983 | Lentz | |
| 4,674,303 | A | * | 6/1987 | Salcone, II | 70/63 |
| 4,675,954 | A | * | 6/1987 | Gullickson | 24/633 |
| 4,731,912 | A | * | 3/1988 | Boriskie et al. | 24/633 |
| 4,901,407 | A | | 2/1990 | Pandola et al. | |
| 4,939,824 | A | | 7/1990 | Reed | |
| 5,161,351 | A | | 11/1992 | Woodruff | |
| 5,307,544 | A | | 5/1994 | Quarberg et al. | |
| 5,416,957 | A | * | 5/1995 | Renzi et al. | 24/633 |
| 5,442,840 | A | | 8/1995 | Ewald | |
| 5,577,300 | A | | 11/1996 | Gutrugianios | |
| 5,617,617 | A | | 4/1997 | Gustin | |
| 5,884,382 | A | | 3/1999 | Hansen | |
| 6,023,821 | A | | 2/2000 | Murray | |
| 6,105,219 | A | | 8/2000 | Beadle | |
| 6,138,331 | A | | 10/2000 | Powers | |
| 6,332,252 | B1 | | 12/2001 | Powers | |
| 6,385,822 | B1 | | 5/2002 | Dean et al. | |
| 6,463,637 | B1 | | 10/2002 | Carnahan | |
| 6,543,096 | B2 | | 4/2003 | Settlemayer et al. | |
| 6,631,537 | B1 | | 10/2003 | Huang | |
| 6,668,433 | B1 | | 12/2003 | Hood | |
| 6,688,086 | B2 | | 2/2004 | Foerderer | |
| 6,760,958 | B2 | | 7/2004 | Tejima | |
| 6,769,157 | B1 | * | 8/2004 | Meal | 24/633 |

* cited by examiner

*Primary Examiner*—Robert J Sandy
*Assistant Examiner*—Marcus Menezes
(74) *Attorney, Agent, or Firm*—Zarian Midgley & Johnson PLLC

(57) ABSTRACT

The invention is a protective cover for a buckle, for protecting a vehicle from the buckle, which may be used with a strap to secure loads such as kayaks, rafts, and canoes to the vehicle roof. The buckle and its attached strap can be inserted into the protective cover, and can later be removed from the protective strap if desired. The release lever of the buckle is covered by the protective cover, and is depressed by pressing down on a portion of the protective cover.

18 Claims, 2 Drawing Sheets

BUCKLE BUMPER

BACKGROUND OF THE INVENTION

1. Field of the Invention

The present invention generally relates to straps and buckles, and more particularly to protective coverings for straps and buckles.

2. Background Information

Equipment such as canoes, kayaks and rafts are often loaded onto the roof of a vehicle for transport. A long strap with a metal buckle at one end is typically the method used for securing loads such as these. The metal buckle of such a strap can accidentally strike the roof of the vehicle, be dragged along the roof of the vehicle or may be in contact with the roof during transport. Any of these actions can result in the paint of the vehicle being scratched.

What is needed is a protective cover that fits over a standard type of buckle. The more that this encloses the buckle, the better such a strap would be. Therefore, it is an object of the present invention to provide a protective cover that may be utilized with a standard configuration of buckle, and that completely protects the vehicle from being scratched by the buckle.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other objects are accomplished by the protective cover of the invention. The invention is a protective cover that fits over a buckle of the type that is used to secure loads on a vehicle. Such a buckle has a strap attached to it, and the free end of the strap feeds into the buckle and is locked in place. The protective cover goes over the buckle and accommodates the strap attached to the buckle, and protects surfaces from being scratched or chipped by the hard metal of the buckle.

The protective cover of the invention can be used with a number of types of buckles, but is particularly suitable for a cam buckle in use at the current time. Such a buckle is a type that uses a camming action to secure the strap end, while the camming action is released by a lever. Such a buckle typically has a left and a right side that are attached to each other through several posts. One of the posts is a strap gripping post, which typically has ridges or teeth on it, to facilitate gripping the strap when the strap is pressed against it by a locking lever. Another post that holds the left and right side together is the strap attachment post, which is located at the opposite end of the buckle from the strap gripping post. The strap attachment post is available for permanently attaching one end of the strap to the buckle. The strap can be looped around the strap attachment post and sewn permanently in place. The protective cover of the invention would work equally well with buckles that did not have a strap permanently attached.

The buckle would typically include a locking lever that is rotatable about an axle, with one end being a gripping end for camming action against the strap end when it is pressed between the strap gripping post of the buckle and the gripping end. The other end of the locking lever is a release end, and by pressing down on the release end the camming action on the strap is released and the strap end may be withdrawn from the buckle. The buckle also has a buckle top and a buckle bottom, and a strap including an attached end that is attached to the strap attachment post, and a strap free end that is looped around the object being secured and fed into a strap entry slot where it is gripped by the locking lever.

The protective cover of the invention is made of a non-scratching and resilient material such as rubber, vinyl or other flexible and resilient material. The resilient cover body has a cover interior that is sized to fit snugly around a particular design of buckle. The cover body of the protective cover includes a cover sidewall that extends in a generally rectangular shape completely around the buckle. It encloses the buckle sides, front and back. The cover sidewall includes four sides: a back sidewall, a front sidewall, a left sidewall and a right sidewall. It also includes a cover top and a cover bottom that joins the left, right and rear sidewalls of the cover together. The back sidewall of the cover defines a strap exit slot through which the strap attached to the buckle can exit the protective cover. The bottom side of the cover can define another strap entry slot through which the free end of the strap can pass and thus pass between the gripping end of the lever and the strap gripping post of the buckle. The cover top side defines a strap exit slot through which the free end of the strap can pass and thus exit the buckle.

The cover top side covers the release end of the locking lever. This is different than some prior art, which specifically leaves a gap for accessing the release end of the locking lever. The cover of the present invention completely covers over the release end of the locking lever. However, the cover top side is thin enough that it can be pressed in against the release side of the lever, and the lever can be released without removing the protective cover from the buckle. This serves to protect the buckle from grit and debris, and protectively covers the release end of the lever, which typically protrudes above the sides of the buckle.

One version of the protective cover includes left, right and rear sidewalls that are wider than the left and right side of the buckle. In this version the front sidewall is narrower than the sidewalls of the buckle.

One design feature of the protective cover is that in the cover interior are a number of spacers that are used for centering and securing the buckle within the interior of the cover. The spacers can take the form of a ridge formed around the interior of the sidewalls, or it can take the form of a number of blocks that are attached to the interior of the sidewall and which center and secure the buckle.

In another embodiment of the device, the cover bottom side includes a second strap exit slot. The bottom slot is used when the bumper is installed on the strap in production at the factory. The webbing enters the rear slot, wraps around the buckle and exits the bottom slot to be sewn behind the buckle/bumper together with the webbing, making the bumper permanently fixed on the strap. For after market applications the bumper can be added or removed simply by sliding it on the webbing, through the rear slot.

One optional design of the device includes an exterior ridge that goes around the circumference of the sidewalls. This exterior ridge provides additional protection of the surface of the vehicle from being scratched by the buckle.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
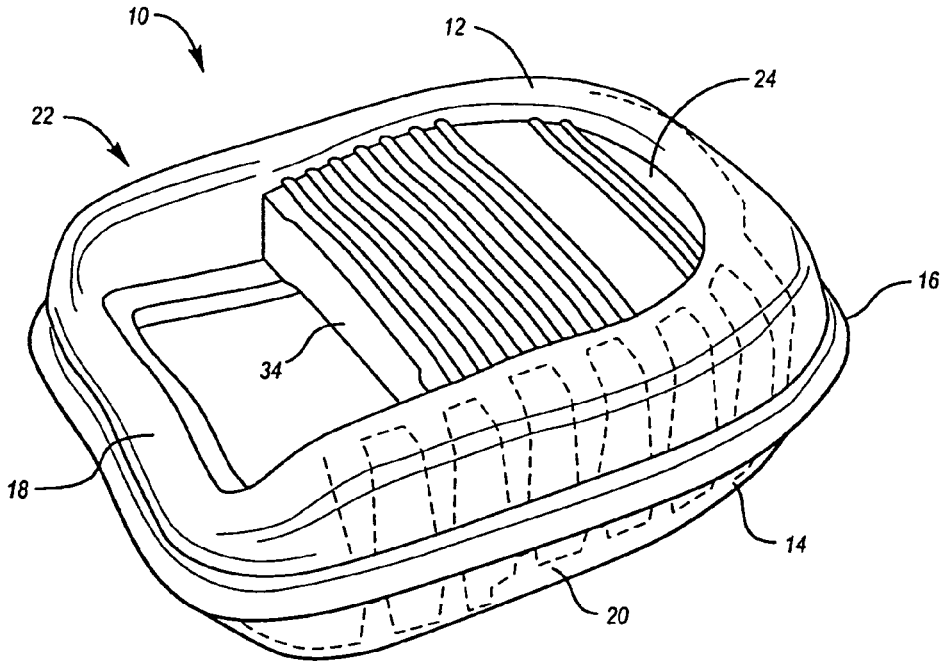
FIG. 1 is a perspective view of the buckle bumper of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
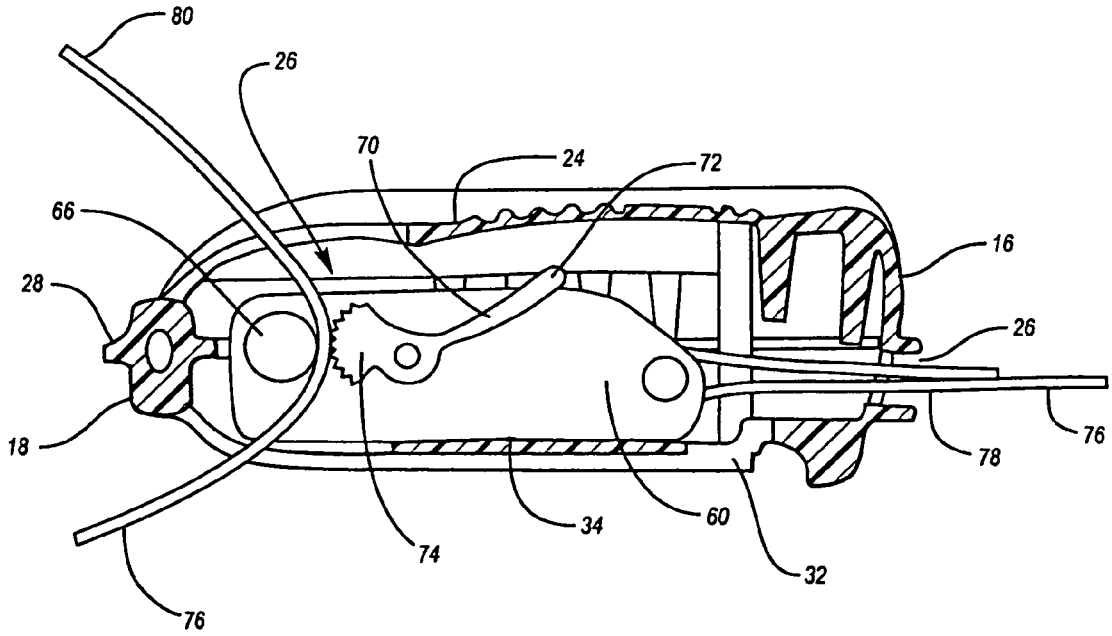
FIG. 2 is a cross sectional side view of the buckle bumper of the invention and a buckle.
Figure 3:
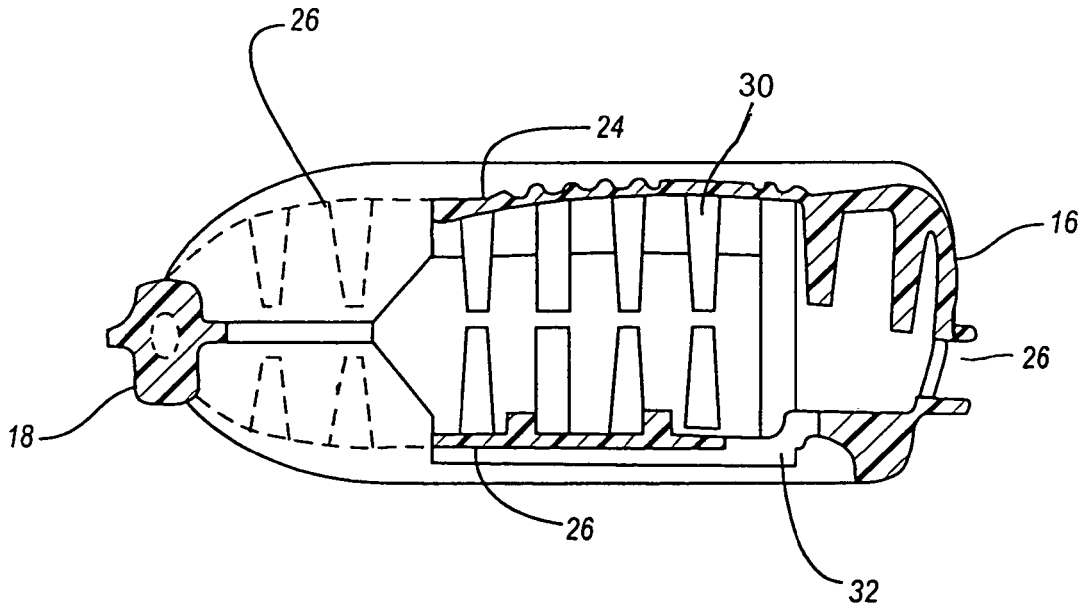
FIG. 3 is a cross sectional side view of the buckle bumper without the buckle.
Figure 4:
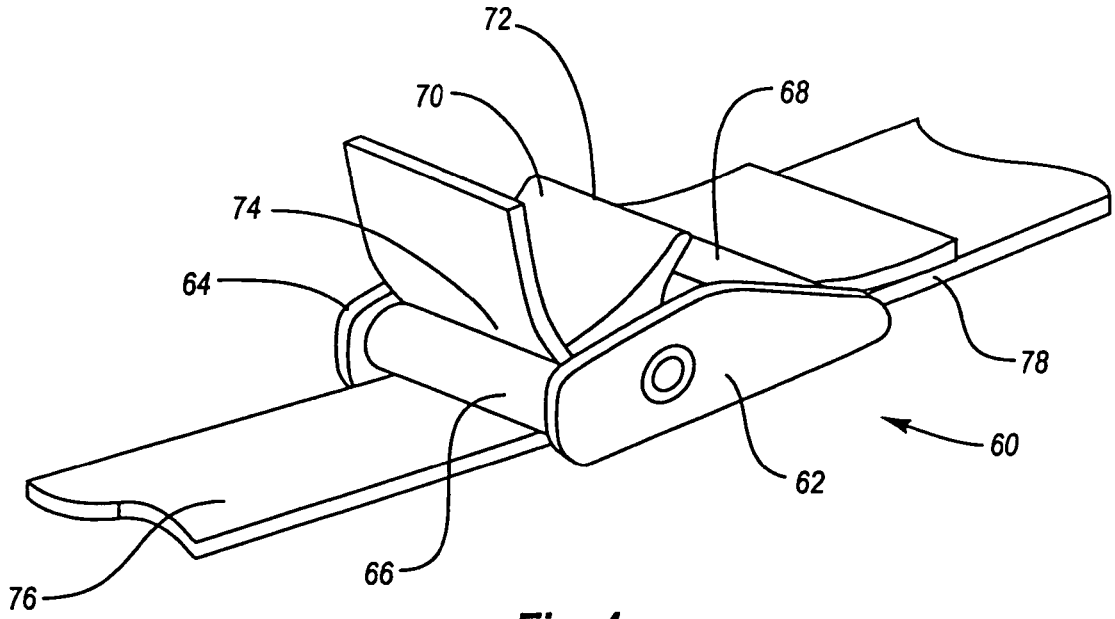
Fig. 4 Prior Art
FIG. 4 is a perspective view of a prior art buckle.

The preferred embodiment of the invention is shown in FIGS. 1-3. The invention is a protective cover for a buckle, and which the buckle is the type with an attached strap. Although this protective cover could work with a number of different styles of buckles, the preferred embodiment works with a type of buckle called a cam buckle, an example of which is shown in FIG. 4. The cam buckle 60 has a left side 62 and a right side 64. These two plates are held in a spaced relationship to each other by a strap gripping post 66 and a strap attachment post 68. The cam buckle 60 also has a locking lever 70. The locking lever 70 has a release end 72 and a gripping end 74. The gripping end 74 presses against the strap gripping post 66, and when a strap 76 is inserted into the space between the gripping end 74 and the strap gripping post 66, it prevents the strap 76 from being withdrawn in the direction indicated as W. The strap 76 has an attached end 78 and a free end 80.

The protective buckle cover 10 of the invention is shown in FIG. 1. It includes a resilient cover body 12. The cover body 12 is made up of a cover sidewall 14, which extends around all four sides of the cover. The four sides of the cover sidewall 14 are the back sidewall 16, the front sidewall 18, the left sidewall 20 and the right sidewall 22. The cover body 12 also includes a cover top side 24 and cover bottom side 34 that are connected to the left and right sidewalls 20, 22. The back sidewall 16 defines a strap exit slot 26, through which the strap 76 passes. The cover top side 24 covers the locking lever 70 of the buckle 60. The cover top side 24 also defines a strap exit slot 26 through which the free end 80 of the strap 76 can pass.

A material that has been found to be suitable for making the protective buckle cover 10 is polyurethane, although any flexible and resilient material would also be suitable. Possible materials include rubber, polypropylene, polyethylene and other types of plastics.

The cover top side 24 covers the release end 72 of the locking lever 70, but is flexible enough so that the release end 72 of the locking lever 70 may be depressed by pressing on the cover top side 24. Having the cover top side 24 cover the release end 72 of the buckle 60 protects objects such as the vehicle roof the buckle might be used. This is because the release end 72 of the locking lever 70 typically protrudes slightly above the left side 62 and right side 64 of the buckle 60. Having a cover top side cover, this portion of the buckle provides additional safety to the vehicle. The cover top side 24 covers as much of the buckle 60 as possible which also keeps grit, dirt and debris out of the buckle mechanism, and allows it to work a longer period of time between cleaning.

Although not essential for the operation of the buckle 60, the preferred embodiment of the buckle includes a front sidewall 18, which is narrower than the other three sidewalls. The front sidewall 18 includes an exterior ridge 28, which extends around the circumference of the sidewall.

FIG. 3 shows several internal components of the cover body 12. These include spacer bars 30 that are located along the interior of the left sidewall 20 and the right sidewall 22. Spacer bars 30 help to center and position the buckle 60. Also shown more clearly in FIG. 3 are the strap exit slot 26 and the bottom strap slot 32.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A protective cover for a buckle with an attached strap, said buckle including a buckle left side and buckle right side, held in spaced relationship to each other by a strap gripping post and a strap attachment post, a locking lever with a release end and a gripping end mounted between said buckle left and right sides, with said gripping end of said lever forming a strap end entry slot adjacent said strap gripping post, a buckle top, buckle bottom, said strap including an attached end attached to said strap attachment post, and a strap free end, said cover comprising: a resilient cover body defining a cover interior for placement of said buckle, said cover body comprising a cover sidewall configured to circumvolve said buckle in a generally rectangular shape around said buckle back edge, buckle front edge, buckle left side and buckle right side, said cover sidewalls including a back sidewall, a front sidewall, a left sidewall and a right sidewall, and which includes a cover top side and a cover bottom side connected to said left and right and back sidewalls, thus forming a six sided buckle cover;

said back sidewall defining a strap exit slot for said attached strap on said buckle;

said cover bottom side defining a strap entry slot, through which said free end of said strap can pass and thus pass between said gripping end of said lever and said strap gripping post;

said cover top side defining a strap exit slot, through which said free end of said strap can pass and thus exit said buckle;

with said cover top side covering said release end of said locking lever, with said cover top side being sufficiently flexible to allow depression of said release end of said lever through said cover top side, to release said strap when said buckle is enclosed in said cover; wherein said protective cover prevents any surface of said buckle from touching any generally flat object; and said protective cover further includes an exterior ridge on the exterior of said sidewall, for additional protection of a surface from said buckle.

2. The protective cover of claim 1 which said left, right and rear sidewalls are wider than said left and right side of said buckle, and said front sidewall is narrower than said sidewalls of said cover.

3. The protective cover of claim 1 which further includes one or more buckle spacers on an interior of said sidewalls in said cover interior, for centering and holding said buckle.

4. The protective cover of claim 3 in which said buckle spacer is a ridge inside said cover interior, adjacent to said strap gripping post.

5. The protective cover of claim 3 in which said buckle spacer includes a plurality of buckle spacer bars, to center said buckle in said cover interior.

6. The protective cover of claim 1 in which said cover bottom side further includes a second strap exit slot.

7. A protective cover for a buckle with an attached strap, said buckle including a buckle left side and buckle right side, held in spaced relationship to each other by a strap gripping post and a strap attachment post, a locking lever with a release end and a gripping end mounted between said buckle left and right sides, with said gripping end of said lever forming a strap end entry slot adjacent said strap gripping post, a buckle top, buckle bottom, said strap including an attached end attached to said strap attachment post, and a strap free end, said cover comprising:

a resilient cover body defining a cover interior for placement of said buckle, said cover body comprising a cover sidewall that extends in a generally rectangular shape around said buckle back edge, buckle front edge, buckle left side and buckle right side, said cover sidewalls including a back sidewall, a front sidewall, a left sidewall and a right sidewall, and a cover top side and a cover bottom side connected to said left and right and back sidewalls; said buckle cover comprising one or more buckle spacers on an interior of said sidewalls in said cover interior, for centering and holding said buckle;

said back sidewall defining a strap exit slot for said attached strap on said buckle;

said cover bottom side defining a strap entry slot, through which said free end of said strap can pass and thus pass between said gripping end of said lever and said strap gripping post;

said cover top side defining a strap exit slot, through which said free end of said strap can pass and thus exit said buckle;

with said cover top side covering said release end of said locking lever, with said cover top side being sufficiently flexible to allow depression of said release end of said lever through said cover top side, to release said strap when said buckle is enclosed in said cover; wherein said protective cover prevents any surface of said buckle from touching any generally flat object.

8. The protective cover of claim 7 wherein said buckle spacer is a ridge inside said cover interior, adjacent to said strap gripping post.

9. The protective cover of claim 7 wherein said buckle spacer includes a plurality of buckle spacer bars, to center said buckle in said cover interior.

10. The protective cover of claim 7 wherein said left, right and rear sidewalls are wider than said left and right side of said buckle, and said front sidewall is narrower than said sidewalls of said cover.

11. The protective cover of claim 7 wherein said cover bottom side further includes a second strap exit slot.

12. A protective cover for a buckle with an attached strap, said buckle including a buckle left side and buckle right side, held in spaced relationship to each other by a strap gripping post and a strap attachment post, a locking lever with a release end and a gripping end mounted between said buckle left and right sides, with said gripping end of said lever forming a strap end entry slot adjacent said strap gripping post, a buckle top, buckle bottom, said strap including an attached end attached to said strap attachment post, and a strap free end, said cover comprising:

a resilient cover body defining a cover interior for placement of said buckle, said cover body comprising a cover sidewall that extends in a generally rectangular shape around said buckle back edge, buckle front edge, buckle left side and buckle right side, said cover sidewalls including a back sidewall, a front sidewall, a left sidewall and a right sidewall, and a cover top side and a cover bottom side connected to said left and right and back sidewalls;

said buckle cover comprising one or more buckle spacers in the form of a ridge on an interior of said sidewalls in said cover interior, adjacent to said trap gripping post, for centering and holding said buckle;

said back sidewall defining a strap exit slot for said attached strap on said buckle;

said cover bottom side defining a strap entry slot, through which said free end of said strap can pass and thus pass between said gripping end of said lever and said strap gripping post;

said cover top side defining a strap exit slot, through which said free end of said strap can pass and thus exit said buckle;

with said cover top side covering said release end of said locking lever, with said cover top side being sufficiently flexible to allow depression of said release end of said lever through said cover top side, to release said strap when said buckle is enclosed in said cover; wherein said protective cover prevents any surface of said buckle from touching any generally flat object.

13. The protective cover of claim 12 wherein said buckle spacer includes a plurality of buckle spacer bars, to center said buckle in said cover interior.

14. The protective cover of claim 12 wherein said left, right and rear sidewalls are wider than said left and right side of said buckle, and said front sidewall is narrower than said sidewalls of said cover.

15. The protective cover of claim 12 wherein said cover bottom side further includes a second strap exit slot.

16. A protective cover for a buckle with an attached strap, said buckle including a buckle left side and buckle right side, held in spaced relationship to each other by a strap gripping post and a strap attachment post, a locking lever with a release end and a gripping end mounted between said buckle left and right sides, with said gripping end of said lever forming a strap end entry slot adjacent said strap gripping post, a buckle top, buckle bottom, said strap including an attached end attached to said strap attachment post, and a strap free end, said cover comprising:

a resilient cover body defining a cover interior for placement of said buckle, said cover body comprising a cover sidewall that extends in a generally rectangular shape around said buckle back edge, buckle front edge, buckle left side and buckle right side, said cover sidewalls including a back sidewall, a front sidewall, a left sidewall and a right sidewall, and a cover top side and a cover bottom side connected to said left and right and back sidewalls;

said buckle cover comprising one or more buckle spacers including a plurality of buckle spacer bars, on an interior of said sidewalls in said cover interior, for centering and holding said buckle;

said back sidewall defining a strap exit slot for said attached strap on said buckle;

said cover bottom side defining a strap entry slot, through which said free end of said strap can pass and thus pass between said gripping end of said lever and said strap gripping post;

said cover top side defining a strap exit slot, through which said free end of said strap can pass and thus exit said buckle;

with said cover top side covering said release end of said locking lever, with said cover top side being sufficiently flexible to allow depression of said release end of said lever through said cover top side, to release said strap when said buckle is enclosed in said cover; wherein said protective cover prevents any surface of said buckle from touching any generally flat object.

17. The protective cover of claim 16 wherein said left, right and rear sidewalls are wider than said left and right side of said buckle, and said front sidewall is narrower than said sidewalls of said cover.

18. The protective cover of claim 16 wherein said cover bottom side further includes a second strap exit slot.

* * * * *